US006556180B1

(12) United States Patent
Furuhashi et al.

(10) Patent No.: US 6,556,180 B1
(45) Date of Patent: Apr. 29, 2003

(54) LIQUID CRYSTAL DISPLAY DEVICE HAVING IMPROVED-RESPONSE-CHARACTERISTIC DRIVABILITY

(75) Inventors: Tsutomu Furuhashi, Yokohama (JP); Tatsuhiro Inuzuka, Odawara (JP); Hiroshi Kurihara, Mobara (JP); Kikuo Ono, Mobara (JP)

(73) Assignees: Hitachi, Ltd., Tokyo (JP); Hitachi Video & Information System, Inc., Yokohama (JP)

( * ) Notice: Subject to any disclaimer, the term of this patent is extended or adjusted under 35 U.S.C. 154(b) by 141 days.

(21) Appl. No.: 09/655,826

(22) Filed: Sep. 6, 2000

(30) Foreign Application Priority Data

Oct. 18, 1999 (JP) ..... 11-294881

(51) Int. Cl.[7] ..... G09G 3/36; G09G 5/00

(52) U.S. Cl. ..... 345/87; 345/89; 345/100; 345/204

(58) Field of Search ..... 345/58, 87, 89, 345/92, 94, 100, 204, 537, 690, 714–716, 132; 348/790, 674

(56) References Cited

U.S. PATENT DOCUMENTS

| | | | | |
|---|---|---|---|---|
| 5,828,354 A | | 10/1998 | Ebihara | |
| 5,844,533 A | * | 12/1998 | Usui et al. | 345/89 |
| 5,920,300 A | | 7/1999 | Yamazaki et al. | |
| 6,219,016 B1 | * | 4/2001 | Lee | 345/211 |
| 6,222,516 B1 | * | 4/2001 | Oda et al. | 345/100 |
| 6,288,697 B1 | * | 9/2001 | Eto et al. | 345/87 |
| 6,353,435 B2 | * | 3/2002 | Kudo et al. | 345/204 |

FOREIGN PATENT DOCUMENTS

| | | |
|---|---|---|
| EP | 0662767 | 7/1995 |
| EP | 0768637 | 4/1997 |
| JP | 4-288589 | 10/1992 |
| JP | 9-138666 | 5/1997 |
| JP | 10-161587 | 6/1998 |
| WO | 99/05567 | 2/1999 |

OTHER PUBLICATIONS

The Latest Technologies of Liquid Crystals, p.48, published by the Industrial Research Association (in Japanese).

* cited by examiner

*Primary Examiner*—Vijay Shankar
*Assistant Examiner*—Prabodh Dharia
(74) *Attorney, Agent, or Firm*—Antonelli, Terry, Stout & Kraus, LLP

(57) ABSTRACT

A liquid crystal display device in which the time necessary for luminance to change from application of a different gray-scale voltage exceeds one frame period in relation to the response as a luminance change time of the liquid crystal. The liquid crystal display device includes a signal control circuit for preventing the content of a preceding frame from being displayed as an after-image and preventing also deterioration of image quality. The signal control circuit includes a frame memory for delaying by one frame the first display data inputted from the external device, an arithmetic operation circuit for comparing the second display data stored in the frame memory and delayed by one frame with the first display data, and an addition/subtraction circuit for adding and subtracting correction data outputted by the arithmetic operation circuit to and from the first display data.

18 Claims, 8 Drawing Sheets

LIQUID CRYSTAL DISPLAY DEVICE HAVING IMPROVED-RESPONSE-CHARACTERISTIC DRIVABILITY

BACKGROUND OF THE INVENTION

This invention relates to a liquid crystal display device. More particularly, this invention relates to a driving circuit that improves response as a luminance change time of a liquid crystal.

Response of liquid crystals represents generally the time from the application of a voltage to a liquid crystal to the acquisition of desired luminance. This response includes a rise response τr when the state changes from a voltage non-applied state to a voltage applied state and a fall response τd when the state changes from the voltage applied state to the voltage non-applied state. According to Japanese literature, "The Latest Technologies of Liquid Crystals", p48, published by Industrial Research Association, each response can be determined from the following formula:

$$\text{rise response } \tau r=(\eta_i \cdot d^2)/(\in_0 \cdot \Delta_\in \cdot V^2-K_{ii} \cdot \pi^2)$$

$$\text{fall response } \tau d=(\eta_i \cdot d^2)/(k_{ii} \cdot \pi^2)$$

where:

$\eta_i$: viscosity parameter (coefficient of viscosity)

d: liquid crystal cell gap $\Delta_\in$: dielectric anisotropy

V: applied voltage $K_{ii}$: elasticity parameter (elastic modulus)

This response formula of the liquid crystal suggests that in order to improve the response by contriving the liquid crystal material, the viscosity parameter ηi of the liquid crystal material needs to be made small. To improve the response from the aspect of the production process of a liquid crystal panel, the liquid crystal cell gap d needs to be reduced. To improve the response by a driving circuit, a driving voltage (a liquid crystal applied voltage) needs to be increased.

SUMMARY OF THE INVENTION

To elevate the driving voltage (the applied voltage to the liquid crystal) to a high voltage in the method explained above, a liquid crystal driving circuit for generating the driving voltage must be improved. Since the liquid crystal driving circuit generally comprises an integrated circuit, this integrated circuit must be accomplished by means of a high voltage process, and results in the high cost of production. Further, to improve the viscosity parameter of the liquid crystal and the cell gap, the production process of the liquid crystal must be changed drastically, and such a modification also results in a high cost of production.

If the cost of production of the liquid crystal driving circuit is restricted, the response of the liquid crystal cannot be improved. Even when any change occurs in the display content, the content displayed in a preceding frame is displayed as an after-image rasidual image (residual image). As a result, when a figure such as a rectangle, displayed on the liquid crystal panel moves, the rectangle moves with a blurred edge, deteriorating image quality.

This phenomenon is remarkable particularly when the change to intermediate luminance exists. Since dynamic images displayed on a television set, for example, use very often the intermediate luminance display, this problem is likely to occur remarkably.

Unless this problem is solved, it is difficult to apply the liquid crystal display device to television applications, and so forth.

It is an object of the present invention to provide a liquid crystal display device capable of high quality display by inhibiting the content displayed in a preceding frame from being displayed as the after-image.

It is another object of the present invention to provide a driving circuit of a liquid crystal display device capable of subjecting dynamic image portions to discriminate after-image processing.

In other words, the object of the present invention is to provide a liquid crystal display device that improves the response from the point of time at which a signal driving circuit applies a gray-scale voltage corresponding to display data to a liquid crystal panel to the point of time at which the liquid crystal panel displays the gray-scale corresponding to the gray-scale voltage so applied.

It is still another object of the present invention to provide a liquid crystal display device capable of implementing the response described above without changing the properties of liquid crystal material, and so forth.

It is still another object of the present invention to provide a liquid crystal display device that can be adapted to dynamic image display for television, etc, that very often uses intermediate luminance display.

It is a further object of the present invention to provide a liquid crystal display device having versatility without the necessity for changing an external device for outputting display data to the liquid crystal display device.

According to one aspect of the present invention, there is provided a liquid crystal display device comprising a frame memory for storing display data inputted from an external device and arithmetic operation means for comparing first display data inputted from the external device with second display data obtained by delaying by one frame the first display data stored in the frame memory, wherein correction for shortening of the response of a liquid crystal panel is applied to the display data inputted from the external in accordance with the computation result of the arithmetic operation means, and a gray-scale voltage corresponding to the data so corrected is applied to a liquid crystal panel.

In other words, the liquid crystal display device according to the present invention adds the correction data to the display data at a pixel portion at which the display content changes in correspondence with each frame, and changes the gray-scale voltage applied to the pixel portion at which the display content changes, to thereby enhance response capability of the liquid crystal display.

The above and other objects, features and advantages of the present invention will become more apparent from the detailed description of the embodiments of the invention taken in conjunction with the accompanying drawings.

DETAILED DESCRIPTION OF THE EMBODIMENTS

The construction of a liquid crystal display device will be explained with reference to FIGS. 2 to 7 in order to have the principle of the present invention easily understood.

Figure 2:
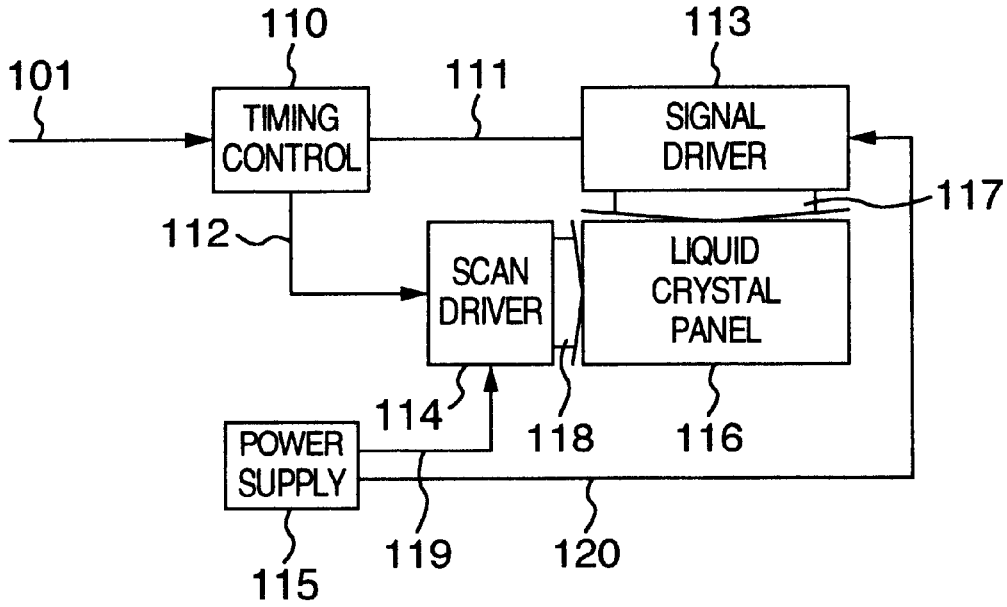
FIG.2 PRIOR ART
FIG. 2 is a block diagram showing a liquid crystal display device according to the prior art.

Referring to FIG. 2 that shows an ordinary liquid crystal display device according to the prior art, reference numeral 101 denotes a data bus for transferring display data and a synchronization (sync) signal inputted from an external device. Reference numeral 110 denotes a timing control circuit for generating various timing signals for a liquid crystal driving circuit. Reference numeral 111 denotes a data bus for transferring the display data and the sync signal generated by the timing control circuit 110. Reference numeral 112 denotes a signal bus for transferring the sync signal generated by the timing control circuit 110. Reference numeral 113 denotes a signal driving circuit for generating a gray-scale voltage corresponding to the display data transferred through the data bus 111. Reference numeral 114 denotes a scan driving circuit for sequentially selecting the lines to which the gray-scale voltage generated by the signal driving circuit 113 is applied. Reference numeral 115 denotes a power supply circuit and reference numeral 116 denotes a liquid crystal panel. Reference numeral 117 denotes a drain line bus for transferring the gray-scale voltage generated by the signal driving circuit 113 to the liquid crystal panel 116. Reference numeral 118 denotes a gate line bus for transferring a scanning voltage generated by the scan driving circuit 114 to the liquid crystal panel 116. Reference numeral 119 denotes a power supply bus for transferring the power supply voltage to the scan driving circuit 114. Reference numeral 120 denotes a power supply bus for transferring the power supply voltage to the signal driving circuit 113.

Figure 3:
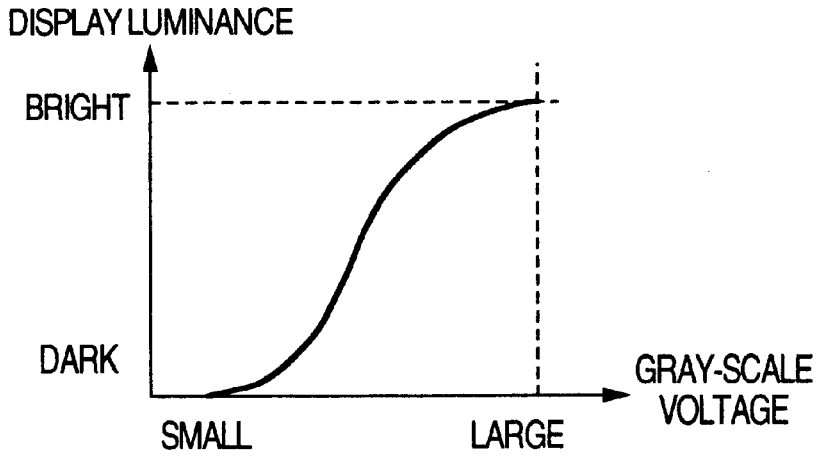
FIG. 3 is a voltage-luminance characteristic diagram showing the relation between a gray-scale voltage and display luminance of a liquid crystal panel.

In FIG. 3, the abscissa represents the gray-scale voltage level applied to the liquid crystal and the ordinate represents luminance.

Figure 4:
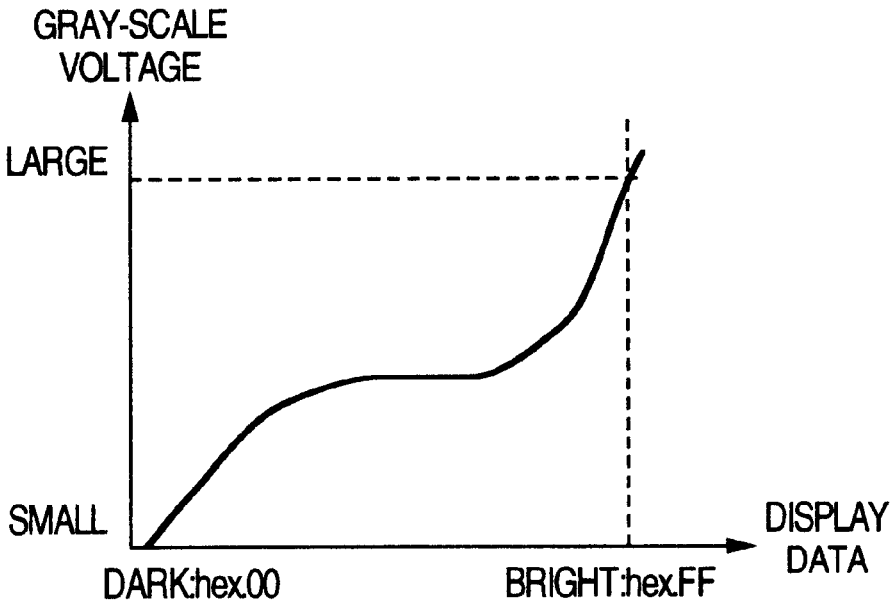
FIG. 4 is a display data versus gray-scale voltage characteristic diagram of a signal driving circuit showing the relation between display data and a gray-scale voltage.

In FIG. 4, the abscissa represents the display data and the ordinate represents the gray-scale voltage, and they are accomplished by the signal driving circuit 113 shown in FIG. 2. Incidentally, the display data is assumed to express 256 gray-scales from hex.00 to hex.FF.

Figure 5:
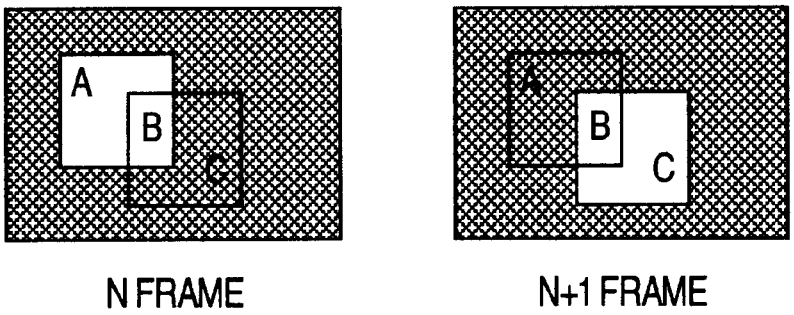
FIG. 5 is an image view showing the mode in which the display content changes.

FIG. 5 shows that the square displayed in the region inclusive of an 'A' point at the time of an N frame moves to the region inclusive of a 'B' point and 'C' point at the time of an (N+1) frame. Therefore, the display content changes between the 'A' point and the 'C' point but remains unaltered at the 'B' point.

Figure 6:
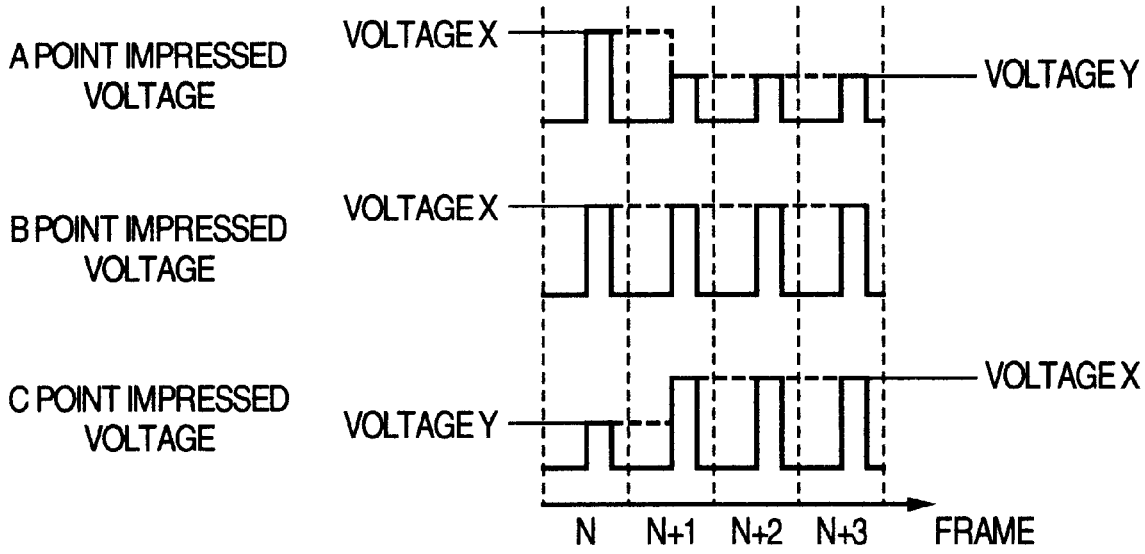
FIG. 6 is a diagram showing gray-scale voltages to be applied to a liquid crystal under the state where the display content shown in FIG. 5 changes.

FIG. 6 shows the gray-scale voltage levels applied to each liquid crystal at the 'A' point, the 'B' point and the 'C' point for each frame time with respect to the change of the display content shown in FIG. 5.

Figure 7:
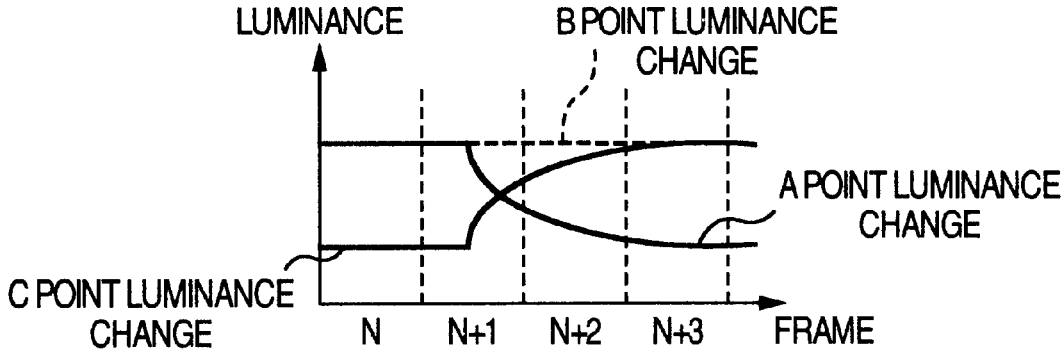
FIG. 7 is state diagram showing the change of display luminance under the state where the display content shown in FIG. 5 changes.

FIG. 7 corresponds to the change of the display content shown in FIG. 5. The abscissa represents the frame time and the ordinate represents the luminance change at each of the 'A', 'B' and 'C' points.

Next, the operation will be explained in detail with reference to FIG. 2 and so on.

The display data, the control signal (not shown) and the sync signal inputted from the external device through the bus 101 are converted to the display data and the sync signal for operating the signal driving circuit 113 and the scan driving circuit 114 through the timing control circuit 110, and are then transferred to the data bus 111 and the signal bus 112. The signal driving circuit 113 converts the display data transferred through the data bus 111 to the corresponding gray-scale voltage and outputs it to the drain line bus 117. The gray-line voltage transferred through the drain line bus 117 is applied to the liquid crystal panel 116, where display is executed with display luminance corresponding to the display data and is visible to human eyes. This operation will be explained about the relation between the gray-scale voltage and display luminance and the relation between the display data and the gray-scale voltage in FIGS. 3 and 4, respectively.

In FIG. 3, when the potential level of the gray-scale voltage is high, the transmission factor of the liquid crystal panel 117 becomes low and display becomes low luminance display. In FIG. 4, "white" is displayed when the display data is hex.FF, and "black" is displayed when the display data is hex.00. Therefore, when the display data is hex.FF, a gray-scale voltage of a high potential is generated, and display becomes high luminance display shown in FIG. 3. As the value of the display data decreases, the potential level of the gray-scale voltage drops progressively, so that display turns to low luminance display shown in FIG. 3. Consequently, the signal driving circuit 113 performs the operation of converting this display data to the gray-scale voltage simultaneously for all the pixels of one horizontal line.

The scan driving circuit 114 brings the line, to which the gray-scale voltage is to be applied, into the selected state in synchronism with the timing at which the signal driving circuit 113 outputs the gray-scale voltage to the drain line bus 117. This operation is conducted sequentially for each line, and the gray-scale voltages corresponding to the display data of one screen can be applied to the pixel portions. Furthermore, display luminance corresponding to the display data can be acquired. Next, the explanation will be given on the response as the luminance change of the liquid crystal when the display content changes.

It will be assumed hereby that a square picture is displayed at the time of the N frame in the region inclusive of the 'A' point and the 'B' point as shown in FIG. 5. In this instance, the background is displayed at the 'C' point. This square picture moves to the region inclusive of the 'B' point and the 'C' point in the (N+1) frame. In this instance, the display content changes from the square display to the background display at the 'A' point but remains unchanged at the 'B' point, and changes from the background display to the square display at the 'C' point. To materialize the change of the display content, the gray-scalle voltage applied to the liquid crystal of each pixel portion is changed.

Therefore, the voltage X is applied in the N frame at the 'A' point but the voltage Y is applied in the (N+1) frame and so on as shown in FIG. 6. The voltage X is applied consecutively at the 'B' point in the N frame, the (N+1) frame and so on. At the 'C' point, the voltage Y is applied in the N frame and the voltage X is applied in the (N+1) frame and so on. As to the luminance change state at this time, no change occurs in the gray-scale voltage to be applied to the liquid crystal and display luminance remains stable because no change exists at the 'B' point in the display content as shown in FIG. 7. At the 'A' point, on the other hand, the display content changes during the shift from the N frame to the (N+1) frame. Therefore, the change occurs in the gray-scale voltage to be applied to the liquid crystal, too. Since different gray-scale voltages are applied to the liquid crystals at this time, the time in which luminance changes sometimes needs the time exceeding one frame period. In this case, the luminance change becomes smooth as shown in FIG. 7 and reaches the target luminance level after the (N+2) level and so on. This also holds true of the luminance change of the 'C' point. In other words, there is the case where the change of the luminance display characteristics of the liquid crystal is slow even when the gray-scale voltage to be applied to the liquid crystal changes.

Figure 1:
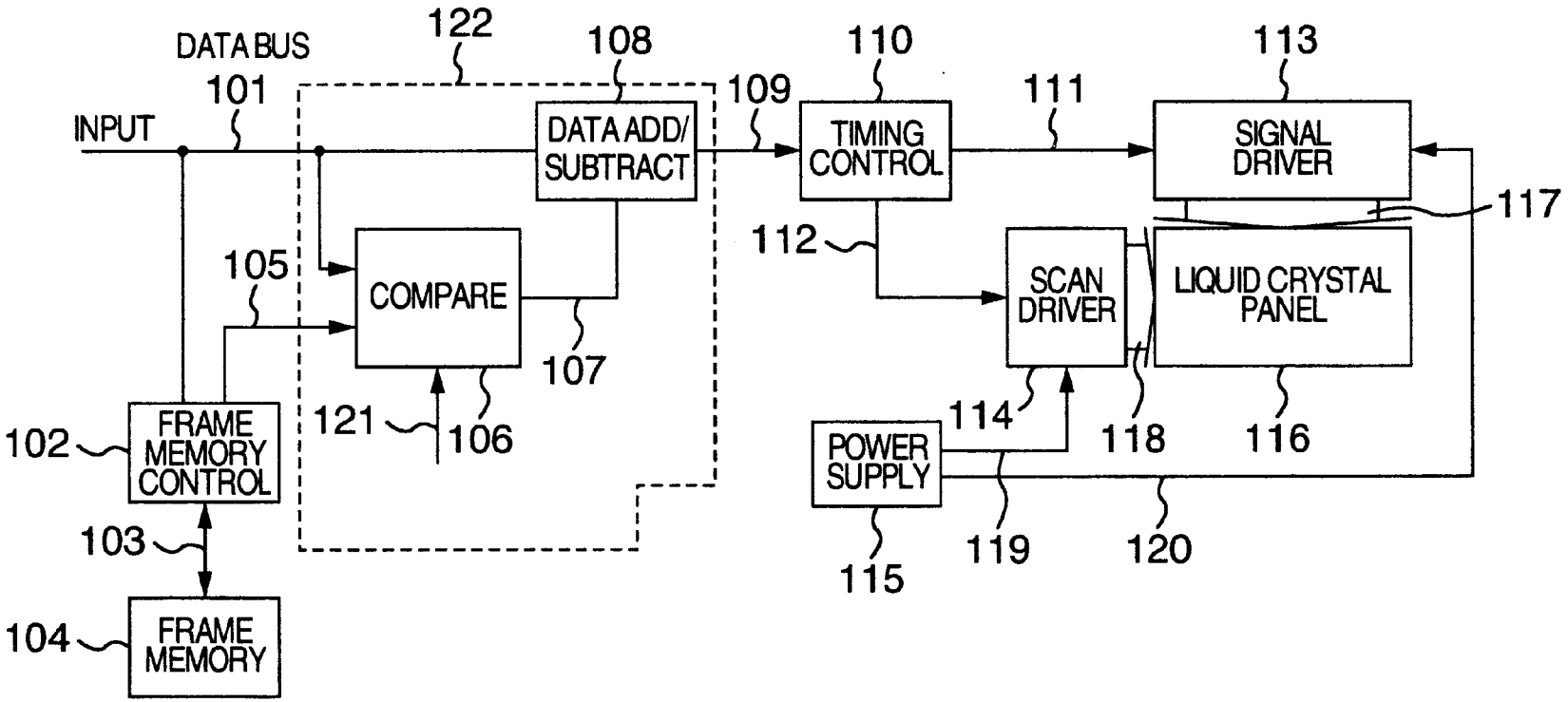
FIG. 1 is a block diagram showing a liquid crystal display device according to an embodiment of the present invention.
Figure 8:
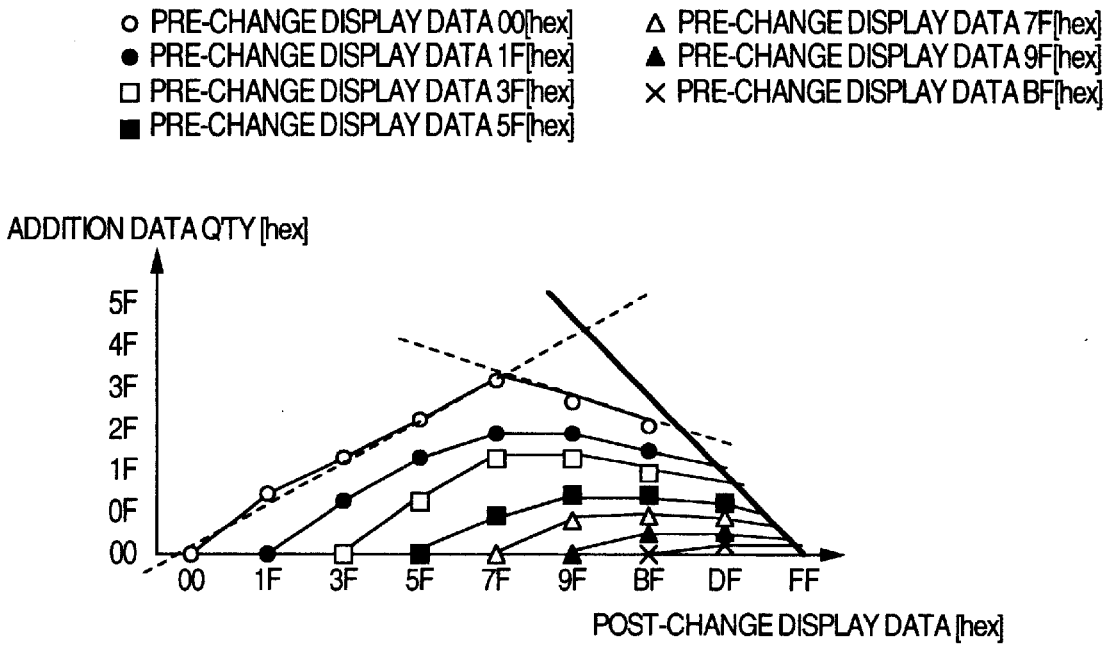
FIG. 8 is a diagram showing an example of correction data (addition data) for display data in the present invention.
Figure 9:
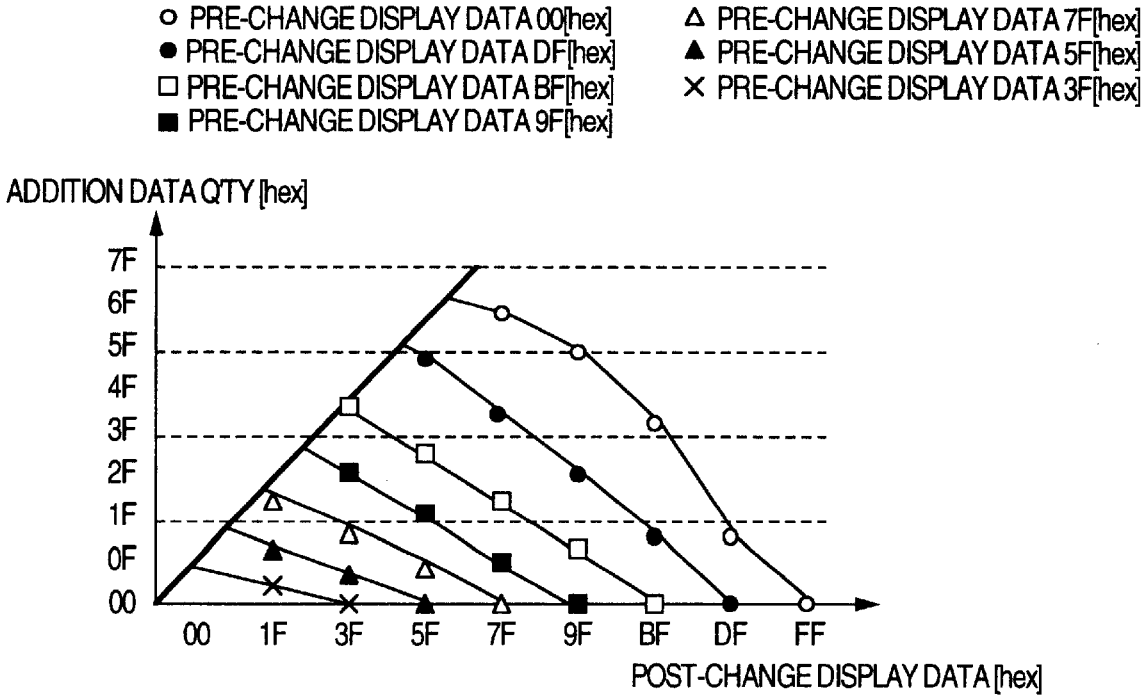
FIG. 9 is a diagram showing an example of correction data (subtraction data) for the display data in the present invention.
Figure 10:
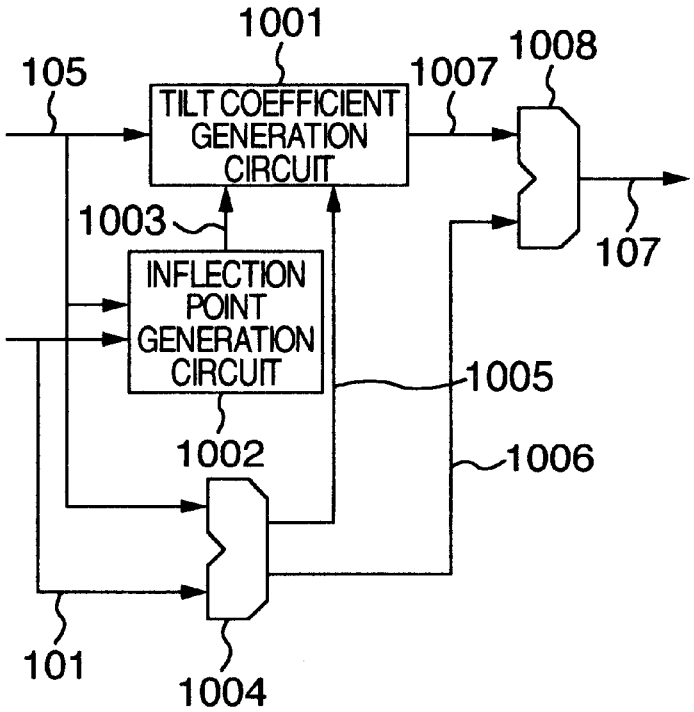
FIG. 10 is a block diagram showing an example of an addition/subtraction data generation circuit in the present invention.
Figure 11:
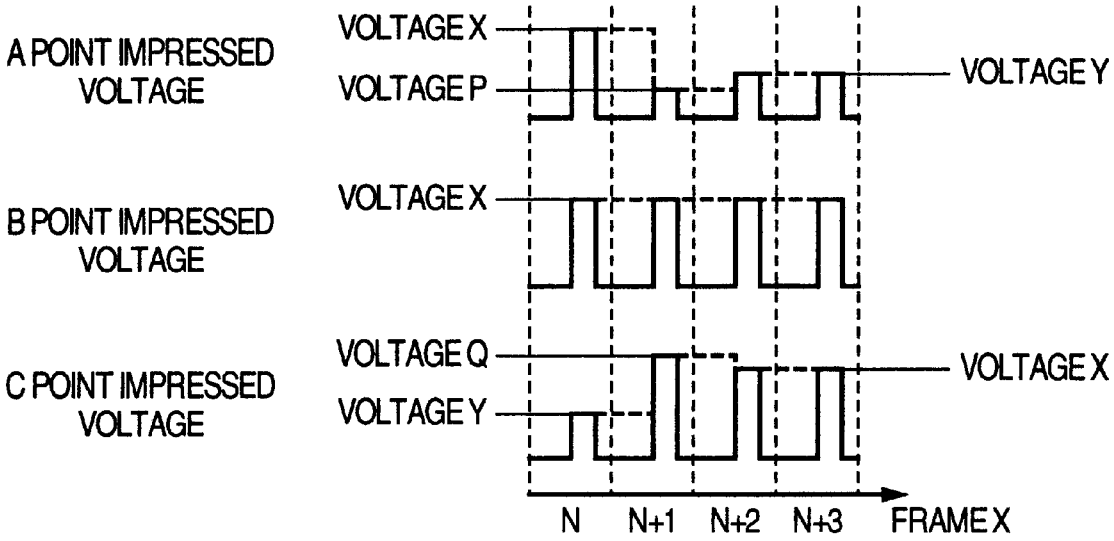
FIG. 11 is a waveform diagram useful for explaining the applied state of the gray-scale voltage in the present invention.
Figure 12:
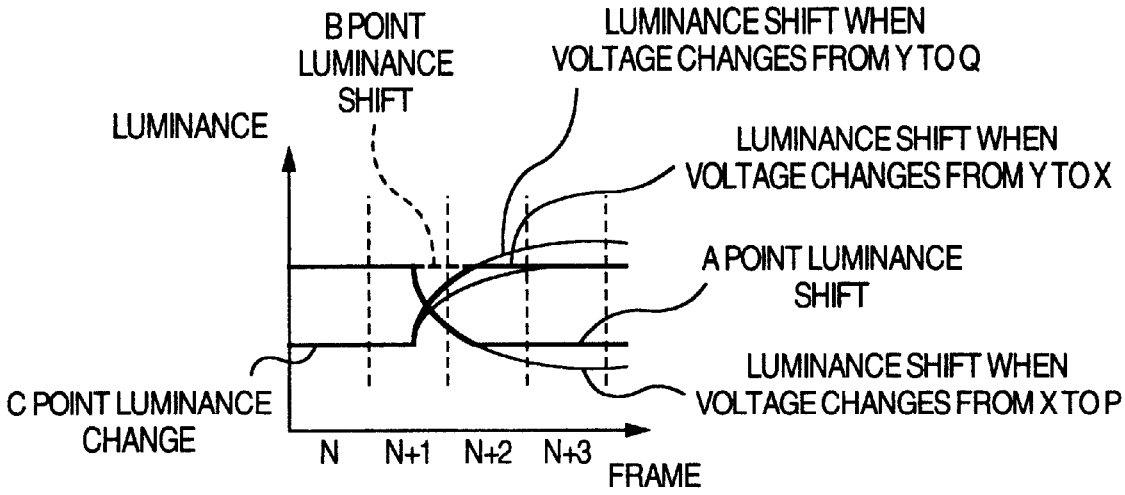
FIG. 12 is a waveform diagram useful for explaining the luminance change state in the present invention.
Figure 13:
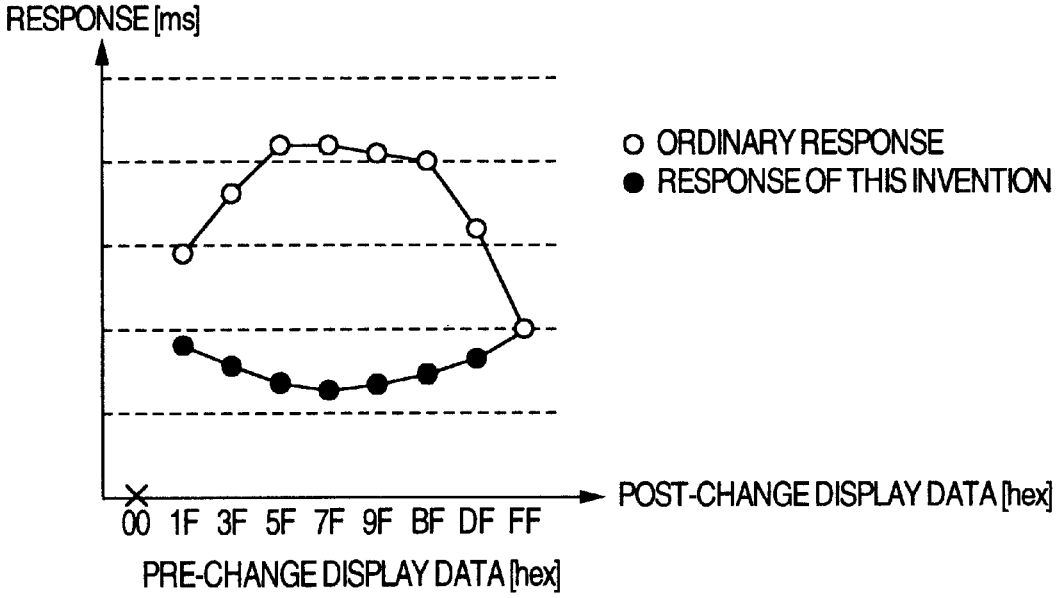
FIG. 13 is a characteristic diagram useful for explaining the liquid crystal response in the present invention.
Figure 14:
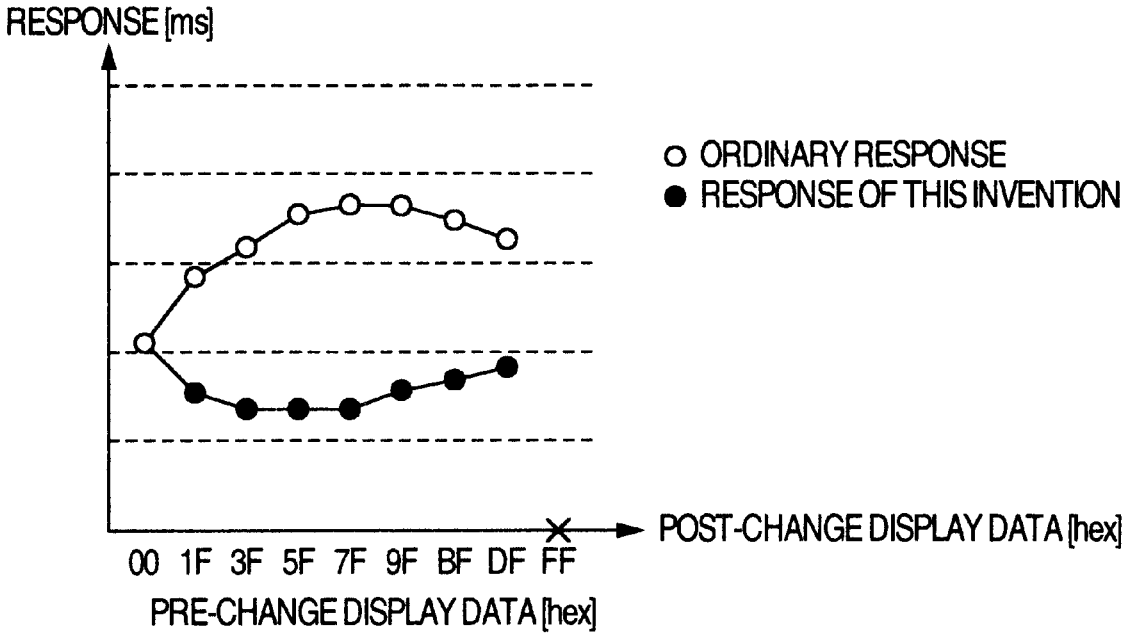
FIG. 14 is another characteristic diagram useful for explaining the liquid crystal response in the present invention.

FIG. 1 is a block diagram of the liquid crystal display device according to the present invention. FIGS. 8 and 9 show the correction data quantities (addition data quantity and subtraction data quantity) of the liquid crystal of display portions at which the display content changes. FIG. 10 is a detailed block diagram of the addition/subtraction data generation circuit shown in FIG. 1. FIG. 11 shows the gray-scale voltage level to be applied to the liquid crystals of dispaly portions at which the display content changes. FIG. 12 shows the change of display luminance relative to the application of the gray-scale voltage shown in FIG. 11. FIGS. 13 and 14 show the response of the liquid crystal.

In FIG. 1, reference numeral 101 denotes a bus for transferring display data and a sync signal inputted from an external device. Reference numeral 102 denotes a frame memory control circuit. Reference numeral 103 denotes a frame memory control bus. Reference numeral 104 denotes a frame memory. Reference numeral 105 denotes a data bus for transferring the display data read out from the frame memory 104. Reference numeral 106 denotes an addition/subtraction data generation circuit for comparing the display data transferred through the data bus 101 with display data transferred through the data bus 105. Reference numeral 107 denotes a data bus for transferring addition/subtraction coefficient data generated by the addition/subtraction coefficient data generation circuit 106. Reference numeral 121 denotes a mode signal. The mode signal is used for selecting the addition/subtraction coefficient data in accordance with the response characteristics of a liquid crystal material. Reference numeral 108 denotes a data addition/subtraction circuit for converting the display data transferred through the data bus 101 on the basis of the addition/subtraction coefficient data 107. Reference numeral 109 denotes a bus for transferring a control signal for executing timing control of the display data generated by the addition/subtraction circuit 108, the sync signal, and so forth.

Reference numeral 110 denotes a timing control circuit for generating various timing signals of the liquid crystal driving circuit. Reference numeral 111 denotes a bus for transferring display data and the sync signal generated by the timing control circuit 110. Reference numeral 112 denotes a bus for transferring the sync signal generated by the timing control circuit 110 to a scan driving circuit 114. Reference numeral 113 denotes a signal driving circuit for generating a gray-scale voltage corresponding to the display data transferred through the bus 111. Reference numeral 114 denotes a scan driving circuit for selecting sequentially the lines to which the gray-scale voltages generated by the signal driving circuit 113 are applied. Reference numeral 115 denotes a power supply circuit. Reference numeral 116 denotes a liquid crystal panel. Reference numeral 117 denotes a drain line bus for transferring the gray-scale voltage generated by the signal driving circuit 113 to the liquid crystal panel 116. Reference numeral 118 denotes a gate line bus for transferring the scanning voltage generated by the scan driving circuit 114 to the liquid crystal panel 116.

Reference numeral 119 denotes a power supply bus for transferring a power source voltage to the scanning driving circuit. Reference numeral 120 denotes a power supply bus for transferring the power supply voltage to the signal driving circuit 130.

Reference numeral 121 denotes a mode signal for adjusting an addition data quantity and a subtraction data quantity corresponding to the response of the liquid crystal. Reference numeral 122 denotes an integrated circuit block in which the driving circuits for accomplishing high-speed response of the liquid crystal of this embodiment are integrated.

FIG. 8 shows display data-to-addition data quantity characteristics when the display data changes from dark gray-scale display to bright gray-scale display. The abscissa represents post-change display data, and the ordinate represents the addition data quantity for each before-change display data.

FIG. 9 shows display data-to-subtraction display data quantity characteristics when the display data changes from bright gray-scale display to dark gray-scale display. The abscissa represents the post-change display data and the ordinate represents the addition data quantity for each before-change display data.

In FIG. 10, the display data is inputed from the external device such as a television tuner or a video recorder (which naturally inputs digital data through the bus 105, when it outputs the analog data, after the analog data is converted to the digital data by a digital data converter), or an information processing unit such as a personal computer. The greater the value of this display data, the brighter becomes the pixel. The smaller the value, the darker becomes the pixel. Reference numeral 1001 denotes a tilt coefficient generation circuit. Reference numeral 1002 denotes an inflection point generation circuit. Reference numeral 1003 denotes a data bus for transferring the inflection point data generated by the inflection point generation circuit 1002. Reference numeral 1004 denotes an arithmetic operation unit for comparing and computing the display data transferred through the data bus 101 with the display data transferred through the data bus 105. Reference numeral 1005 denotes a data bus for transferring the comparison result of the display data transferred through the data bus 105. Reference numeral 1006 denotes a data bus for transferring the difference value between the display data transferred through the data bus 101 and the display data transferred through the data bus 105. Reference numeral 1007 denotes a data bus for transferring the tilt coefficient data generated by the tilt coefficient generation circuit 1001. Reference numeral 1008 denotes an arithmetic operation unit for computing the tilt coefficient data transferred through the data bus 1007 and the difference data transferred through the data bus 1006.

FIG. 11 shows a gray-scale voltage level to be applied to each liquid crystal at each of the 'A', 'B' and 'C' points for each frame time relative to the change of the display content shown in FIG. 5. The display content shown in FIG. 11 includes moving images at the 'A' and 'C' points and a still image at the 'B' point, for example.

FIG. 12 corresponds to the change of the display content shown in FIG. 5. The abscissa represents the frame time and the ordinate represents display luminance. The graph shows a luminance change at each of the 'A', 'B' and 'C' points.

In FIG. 13, the ordinate represents response time of the liquid crystal and the abscissa represents the post-change display data. The response of the liquid crystal display device according to the prior art and the response of the liquid crystal display device according to the present invention, when the before-change display data is hex.00, are plotted by circles and dots, respectively in this graph. The term "response of liquid crystal" used in this embodiment means the time from the point at which the gray-scale voltage is applied to the pixel of the TFT liquid crystal panel 116 by the signals from the signal driving circuit 113 and the scan driving circuit 114 in FIG. 1 to the point at which the gray-scale voltage so applied is displayed.

In FIG. 14, the ordinate represents the response of the liquid crystal and the abscissa represents the post-change display data in the same way as in FIG. 13. The response of the liquid crystal display device according to the prior art and that of the liquid crystal display device according to the present invention are plotted by circles and dots, respectively when the before-change display data is hex.FF.

Next, the operation will be explained in detail with reference to FIG. 1 and so on.

In the liquid crystal display device of the present invention, the display data and the sync signal inputted from the external device through the bus 101 are stored in the frame memory 104 through the frame memory control circuit 102 and the frame memory control bus 103. The frame memory control circuit 102 serially reads out the display data stored in the frame memory 104 after the passage of one frame, and serially outputs them through the data bus 105. The frame memory control circuit 102, the frame memory control bus 103 and the frame memory 104 serially repeat this operation.

Therefore, in the display data inputted to the addition/subtraction data generation circuit 106, becomes the display data that is belated by one frame with respect to the display data transferred through the data bus 105. The gray-scale change of the pixels corresponding to two consecutive frames is computed in this way. As a result, the addition/subtraction data generation circuit 106 can judge whether or not any change exits in the display data between the frames.

When the change exists in the display data between the frames, the addition/subtraction data generation circuit 106 can compute the addition/subtraction coefficient data as correction data to be transferred through the data bus from the relationship between the before-change display data and the post-change display data. The addition/subtraction coefficient data to be transferred through the data bus 107 have the characteristics shown in FIGS. 8 and 9.

These characteristics are found out as a result of experiments conducted by the present inventor. The form of the addition/subtraction coefficient data shown in FIGS. 8 and 9 is different depending on the materials of the liquid crystal panel, and so forth. FIG. 8 shows the addition display data quantity characteristics when the display data changes from the dark gray-scale display to the bright gray-scale display. In this graph, the addition display data quantity is increased much more as the difference of the post-change display data from the before-change display data becomes greater, and is decreased when the post-change display data quantity exceeds a certain value.

This addition data quantity will be explained below in further detail.

The addition data quantity shown in FIG. 8 is the value that takes the normal response time characteristic shown in FIG. 13 into consideration. In this case, the normal response shown in FIG. 13 is of the black display data of hex.00 as the before-change display data. When the post-display display data is below intermediate luminance, the response is more likely to become slow when the post-change display data is closer to intermediate luminance. When the post-change display data exceeds intermediate luminance, the response tends to increase gradually when the post-change display data is closer to the white display. Therefore, when the post-change display data is below intermediate luminance, the addition data quantity is increased much more, and is decreased much more when the post-change display data exceeds intermediate luminance and is closer to the white display. In this way, it becomes possible to achieve the high-rate response optimized for the response characteristics inherent to the liquid crystal.

Therefore, as shown in FIG. 8, a certain inflection point is provided to the liquid crystal having the normal response characteristic shown in FIG. 13. And, the addition data is increased by linear approximation (broken line) till the inflection point with the increase of the post-change display data, and the subtraction data is decreased by linear approximation (broken line) from the inflection point with the decrease of the post-change display data.

Incidentally, the addition data quantity has an upper limit. The difference between the before-change display data and the post-change display data, as represented by the solid line extending from the post-change display data, this upper limit is hex.FF in FIG. 8. As to the luminance display after the addition data quantity reaches the upper limit, the addition data takes the upper limit value as its value.

Next, FIG. 9 shows the subtraction display data quantity characteristics in the case where the display data changes from the bright gray-scale display to the dark gray-scale display. In this graph, the addition display data quantity is increased much more as the difference of the post-change display data from the before-change display data becomes greater.

The subtraction data quantity will be hereby explained in further detail.

The subtraction data quantity shown in FIG. 9 has the value that takes the normal response time shown in FIG. 14 into consideration. In this case, the before-change display data is the white display data of hex.FF. When the post-change display data exceeds intermediate luminance, the normal response time shown in FIG. 14 has the characteristic such that the closer the post-change display data to intermediate luminance, the slower becomes the response. When the post-change display data is below intermediate luminance, the normal response time has the characteristic such that the closer the post-change display data to the black display, the higher becomes gradually the response.

Therefore, when the post-change display data is below intermediate luminance, the subtraction data quantity is increased much more when the post-change display data is closer to intermediate luminance. When the post-change display data is closer to the black display, the subtraction data quantity is decreased. In this way, high response, that takes the response characteristics inherent to the liquid crystal into consideration, can be accomplished.

As shown in FIG. 8, therefore, a certain inflection point is provided, and the subtraction data having the increasing tendency and the subtraction data having a decreasing tendency are linearly approximated with this inflection point as the boundary. In this embodiment, the inflection point is the upper limit value of the subtraction data quantity (that is, the difference between the before-change display data and the post-change display data as represented by the solid line extending from hex.00 of the post-change display data shown in FIG. 8).

Here, the subtraction data is increased by linear approximation (broken line) till the subtraction data reaches the upper limit, and uses the upper limit value as the subtraction data quantity after the subtraction data quantity reaches the upper limit value. In this way, the addition data and the subtraction data can be optimized by providing the inflection point in consideration of the response characteristic from the before-change display data to the post-change display data and by executing linear approximation with the increase of the post-change display data.

The explanation given above employs linear approximation as means for computing the addition coefficient data quantity and the subtraction coefficient data quantity. However, it is also possible to prepare the addition coefficient data quantity and the subtraction data quantity determined from the before-change display data and the post-change display data in a template, to store them in a memory circuit, and to substitute them for the formula.

Next, the addition/subtraction coefficient data quantity generation circuit 106 shown in FIG. 10 will be explained. The explanation will be given about the case where the before-change display data shown in FIG. 8 is hex.00 for the ease of explanation.

In FIG. 10, a tilt coefficient generation circuit 1001 generates tilt coefficient data from the display data, that is the display data of one preceding frame, transferred through the data bus 105. This tilt coefficient is for computing the addition/subtraction data quantity corresponding to the post-change display data plotted in FIG. 8, and represents the tilt indicated by broken line. In the case of FIG. 8, for example, the post-change display data are below hex.7F and above hex.7F. An inflection point generation circuit 1002 generates this hex.7F as the inflection point and inputs it to the tilt coefficient generation circuit 1001 through the data bus 1003. Another example of the kind of the tilt is the difference between FIG. 8 and FIG. 9. In other words, it is the difference between the case where the before-change display data is greater than the post-change display data and the case where the former is smaller than the latter. The tilt coefficient becomes different in such a case, too. An arithmetic unit 1004 generates this difference, and inputs it to the tilt coefficient generation circuit 1001 through the data bus 1005. Furthermore, the response changes depending on the characteristics of the liquid crystal materials, and a mode signal 121 is inputted therefore to the tilt coefficient generation circuit 1001. The circuit of the tilt coefficient generation circuit 1001 may be modified in accordance with the characteristics of the liquid crystal without disposing this mode signal 121.

As a result of the processes described above, the tilt coefficient generation circuit 1001 transfers the tilt coefficient data to the arithmetic operation unit 1008 through the data bus 1007, and the arithmetic operation unit detects the portion at which the display data changes. In this way, the addition/subtraction coefficient data as the correction data can be generated. Incidentally, when no change occurs in the display data, the difference data transferred through the data bus 1006 becomes '0'. Therefore, the addition/subtraction coefficient data transferred through the data bus 107, too, becomes '0'. Needless to say, the correction data is not added to, or subtracted from, the display data in this case.

Turning back again to FIG. 1, the explanation of the operation will be continued. The addition/subtraction data generated by the addition/subtraction data generation circuit 106 is inputted to the data addition circuit 108 through the data bus 107. In consequence, the data addition/subtraction circuit 108 can add or subtract the correction data to or from the portion at which the display content changes.

In this embodiment, the addition/subtraction data generation circuit 106 and the data addition/subtraction circuit 108 are described separately. For, the addition/subtraction data generation circuit 106 is the circuit that must be optimized in accordance with the characteristics of the liquid crystal. In the explanation of the embodiment, this addition/subtraction data is obtained by linear approximation. However, similar effects can be obtained also by means that stores in advance the addition coefficient data quantity and the subtraction coefficient data quantity obtained from the before-change display data and the post-change display data in a memory circuit, as described already.

These data are converted to the display data and the sync signal for operating the signal driving circuit 113 and the scan driving circuit 114 through the timing control circuit 122 and are transferred to the data buses 111 and 112. The signal driving circuit 113 converts the display data transferred thereto through the data bus 111 to the corresponding gray-scale voltage and outputs it to the drain line bus 117. The signal driving circuit 113 executes the operation of converting this display data to the gray-scale voltage simultaneously for all the pixels of one horizontal line. The scan driving circuit 114 sets the line, to which the gray-scale voltage is applied, to the selection state in synchronism with the timing at which the signal driving circuit 113 outputs the gray-scale voltage to the drain line bus 117. This operation is carried out sequentially for each line, so that the gray-scale voltages corresponding to the display data for one screen can be applied to each pixel portion and furthermore, display luminance corresponding to the display data can be obtained. The the luminance change of the liquid crystal when the display content changes.

In FIG. 5 showing the prior art example, the square is displayed in the display region including the 'A' and 'B' points at the time of the N frame, and the background is displayed at the 'C' point. This square moves to a region inclusive of the 'B' and 'C' points at the time of the (N+1) frame. In this instance, the display content changes from the square display to the background display at the 'A' point, remains unchanged at the 'B' point and changes from the background display to the square display at the 'C' point. The gray-scale voltage applied to the liquid crystal of each pixel portion changes with the change of this display content.

The voltage X is applied at the 'A' point in the N frame. The correction data is subtracted from the original display data in the (N+1) frame because the display content changes, and the voltage P is applied. Since the display content is coincident with that of the (N+1) frame in the (N+2) frame and so on, the voltage Y that is the gray-scale voltage corresponding to the original display data is applied. FIG. 12 shows the luminance shift state representing the response of the liquid crystal from this voltage applied state. The luminance change at the 'A' point changes in the (N+1) frame with the luminance shift in which the voltage changes from the voltage X to the voltage P. The original voltage Y is applied in the (N+2) frame and so on. In consequence, the response of the liquid crystal can be speeded up much more than when the gray-scale voltage corresponding to the display data is applied as in the prior art. This also holds true of the change of the display content at the 'C' point. Since no change exists in the display content at the 'B' point, the voltage X is as such applied in the same way as in the prior art.

In the integrated circuit block 122 produced by integrating the driving circuits for accomplishing the high-speed response of the liquid crystal described above, this embodiment describes the addition/subtraction data generation circuit 106, the data addition/subtraction circuit 108. However, the frame memories 104 and the timing control circuit 110 may be integrated in the same chip as needed.

The embodiment of the present invention can speed up the response of the liquid crystal without changing the characteristics of the liquid crystal materials as shown in FIGS. 13 and 14. Since the content displayed in the preceding frame is not displayed as the after-image, this embodiment provides the effect that high image quality display becomes possible. The embodiment provides greater effects particularly for the display of dynamic images in the televisions using very often the intermediate luminance display.

According to the embodiment of the present invention, the interface portion of the liquid crystal. display device is the same as that of the liquid crystal display device of the prior art. In other words, since the external device for outputting the display data to the liquid crystal display device need not be changed, the present invention can be applied easily to existing systems and can accomplish the liquid crystal display device at a low cost of production.

What is claimed is:

1. A liquid crystal display device comprising:

a correction circuit for detecting the change of a display content of a display pixel portion for each frame from input display data from an external device and correcting said display data in response to a detection result that said display data is a moving image;

a signal driving circuit for generating a gray-scale voltage according to the output of said correction circuit;

a scan driving circuit for sequentially selecting scanning lines to which said gray-scale voltage is to be applied; and a liquid crystal panel including gray-scale voltage lines for transferring said gray-scale voltage from said signal driving circuit, scanning lines stipulated by a signal from said scan driving circuit, said gray-scale voltage lines and said scanning lines being arranged in matrix, and pixel portions formed at the points of intersection of said gray-scale voltage lines and said scanning lines.

2. A liquid crystal display device according to claim 1, further comprising:

a control circuit connected to said correction circuit, said signal driving circuit and said scan driving circuit, for supplying the display data corrected by said correction circuit and a control signal inputted from said external device through said correction circuit to said signal driving circuit and said scan driving circuit, and driving and controlling said signal driving circuit and said scan driving circuit.

3. A liquid crystal display device according to claim 1, wherein said correction circuit includes:

a frame memory for storing temporarily the display data; and a detection circuit for comparing the display data of a first frame to be written into said frame memory with the display data of a second frame as a frame immediately ahead of said first frame, read out from said frame memory.

4. A liquid crystal display device according to claim 3, wherein said correction circuit generates correction data to be added to the display data inputted from said external device on the basis of a difference between a first display data to which a correction data is to be added to the display data and which is written into said frame memory and a second data to be read out from said frame memory and on the basis of a darkness/brightness relation between said first display data and said second display data from the detection result of said detection circuit.

5. A liquid crystal display device according to claim 4, wherein said correction circuit generates a value representing a pixel brighter than said first display data, as display data after correction when said first display data written into said frame memory represents a pixel brighter than said second display data read out from said frame memory, and generates a value representing a pixel darker than said first display data, as display data after correction, when said first display data written into said frame memory represents a pixel darker than said second display data read out from said frame memory.

6. A liquid crystal display device according to claim 3, wherein said correction circuit includes a data addition/subtraction circuit for holding a detected difference of the gray-scales of the display pixel portions for each frame, gray-scale information representing whether or not the change of the gray-scale of the display pixel portion for each frame represents the change from a bright gray-scale to a dark gray-scale and correction data to be added to the display device from said external device corresponding to a relation between said difference of the gray-scales and said gray-scale information, and adding said correction data to said display data from said external device.

7. A liquid crystal display device according to claim 3, wherein said detection means and said correction means are formed on one chip.

8. A liquid crystal display device according to claim 3, wherein said frame memory inputs the display data from said external device and is connected to said external device through a memory control circuit for outputting the display data from said frame memory to said detection means.

9. A liquid crystal display device comprising:

a liquid crystal panel including gray-scale voltage lines for transferring a gray-scale voltage corresponding to display data and scanning lines disposed in matrix, and forming pixel portions at the points of intersection between said gray-scale lines and said scanning lines;

a signal driving circuit for generating a gray-scale voltage corresponding to the display data;

a scan driving circuit for sequentially selecting said scanning lines to which said gray-scale voltage is to be applied;

a control circuit for converting display data and a control signal inputted from an external device to display data and a control signal for controlling said signal driving circuit and said scan driving circuit, respectively; and a correction circuit for applying a gray-scale voltage different from the gray-scale corresponding to the display data supplied from said external device as a correction, to a relevant pixel portion displaying a moving image indicative of the content of a current frame different from the content displayed by a preceding frame.

10. A liquid crystal display device according to claim 9, which performs white display when the gray-scale voltage applied to said liquid crystal panel is high and performs black display when the gray-scale voltage applied to said liquid crystal panel is low, and wherein said correction circuit applies a gray-scale voltage higher than the gray-scale voltage corresponding to the display data supplied from said external device to said pixel portion for effecting higher luminance display than the content displayed in the preceding frame, and applies a gray-scale voltage lower than the gray-scale voltage corresponding to the display data supplied from said external device to a pixel portion effecting lower luminance display than the content displayed in the preceding frame.

11. A liquid crystal display device according to claim 9, which performs black display when the gray-scale voltage applied to said liquid crystal panel is high and performs white display when the gray-scale voltage applied to said liquid crystal panel is low, and wherein said correction circuit applies a gray-scale voltage lower than the gray-scale voltage corresponding to the display data supplied from said external device to a pixel portion for effecting higher luminance display than the content displayed in the preceding frame, and applies a gray-scale voltage higher than the gray-scale voltage corresponding to the display data supplied from said external device to a pixel portion for effecting lower luminance display than the content displayed in the preceding frame.

12. An input display data processing apparatus for use in a liquid crystal display device including:

gray-scale voltage lines for transferring gray-scale voltages corresponding to display data and scanning lines arranged in matrix, and forming pixel portions at the points of intersection between said gray-scale voltage lines and said scanning lines;

a signal driving circuit for generating the gray-scale voltage corresponding to the display data;

a scan driving circuit for sequentially selecting said scanning lines to which said gray-scale voltage is to be applied; and a control circuit for converting display data and a control signal inputted from an external device to display data and a control signal for controlling said signal driving circuit and said scan driving circuit;

said input display data processing apparatus being connected to said control circuit, and including:

a correction circuit for applying a gray-scale voltage different from the gray-scale voltage corresponding to the display data supplied from said external device as a correction, to said pixel portion displaying a moving image indicative of the content of a current frame different from the content displayed in a preceding frame.

13. An input display data processing apparatus according to claim 12, wherein said liquid crystal display device performs white display when the gray-scale voltage applied to said liquid crystal panel is high and performs black display when the gray-scale voltage applied to said liquid crystal panel is low, and said correction circuit applies a gray-scale voltage higher than the gray-scale voltage corresponding to the display data supplied from said external device to a pixel portion for effecting higher luminance display than the content displayed in the preceding frame, and applies a gray-scale voltage lower than the gray-scale voltage corresponding to the display data supplied from the external device to a pixel portion for executing lower luminance display than the content displayed in the preceding frame.

14. An input display data processing apparatus according to claim 12, wherein said liquid crystal display device performs black display when a gray-scale voltage applied to said liquid crystal panel is high and performs white display when the gray-scale voltage applied to said liquid crystal panel is low, and said correction circuit applies a gray-scale voltage lower than the gray-scale voltage corresponding to the display data supplied from said external device to a pixel portion for effecting higher luminance display than the content displayed in the preceding frame, and applies a gray-scale voltage lower than the gray-scale voltage corresponding to the display data supplied from said external device to a pixel portion for executing lower luminance display than the content displayed in the preceding frame.

15. A liquid crystal display device according to claim 1, wherein said correction circuit detects the change of a display content of a display pixel portion for each frame from input display data from an external device, judges whether said display data is a still image or a moving image based on a result of the detection, and corrects said display data in response to a judgement result that said display data is a moving image.

16. A liquid crystal display device according to claim 1, wherein said correction circuit corrects said display data by adding to said display data addition data obtained from a relationship between pre-change display data and post-change display data when said display data changes from dark gray-scale display to bright gray-scale display; and wherein said correction circuit corrects said display data by subtracting from said display data subtraction data obtained from a relationship between pre-change display data and post-change display data when said display data changes from bright gray-scale display to dark gray-scale display.

17. A liquid crystal display device according to claim 9, wherein said gray-scale voltage applied by said correction circuit as a correction corresponds to said display data increased by addition data obtained from a relationship between pre-change display data and post-change display data when said display data changes from dark gray-scale display to bright gray-scale display; and wherein said gray-scale voltage applied by said correction circuit as a correction corresponds to said display data decreased by subtraction data obtained from a relationship between pre-change display data and post-change display data when said display data changes from bright gray-scale display to dark gray-scale display.

18. An input display data processing apparatus according to claim 12, wherein said gray-scale voltage applied by said correction circuit as a correction corresponds to said display data increased by addition data obtained from a relationship between pre-change display data and post-change display data when said display data changes from dark gray-scale display to bright gray-scale display; and wherein said gray-scale voltage applied by said correction circuit as a correction corresponds to said display data decreased by subtraction data obtained from a relationship between pre-change display data and post-change display data when said display data changes from bright gray-scale display to dark gray-scale display.

* * * * *